US008366482B2

(12) United States Patent
Burris et al.

(10) Patent No.: US 8,366,482 B2
(45) Date of Patent: Feb. 5, 2013

(54) RE-ENTERABLE HARDLINE COAXIAL CABLE CONNECTOR

(75) Inventors: Donald Andrew Burris, Peoria, AZ (US); Jan Michael Clausen, Vordingborg (DK); Jimmy Ciesla Henningsen, Holmegaard, AZ (US); Michael Ole Matzen, Vordingborg (DK); Thomas Dewey Miller, Peoria, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 28 days.

(21) Appl. No.: 13/175,874

(22) Filed: Jul. 3, 2011

(65) Prior Publication Data

US 2012/0171895 A1 Jul. 5, 2012

Related U.S. Application Data

(63) Continuation-in-part of application No. 12/502,633, filed on Jul. 14, 2009, now Pat. No. 7,972,176.

(51) Int. Cl.
*H01R 9/05* (2006.01)

(52) U.S. Cl. ..... 439/584

(58) Field of Classification Search ..... 439/583, 439/584
See application file for complete search history.

(56) References Cited

U.S. PATENT DOCUMENTS

| | | | | |
|---|---|---|---|---|
| 3,537,065 | A * | 10/1970 | Winston | 439/584 |
| 4,575,274 | A * | 3/1986 | Hayward | 403/2 |
| 4,854,893 | A * | 8/1989 | Morris | 439/578 |
| 4,923,412 | A * | 5/1990 | Morris | 439/578 |
| 5,011,432 | A * | 4/1991 | Sucht et al. | 439/584 |
| 6,802,739 | B2 * | 10/2004 | Henningsen | 439/584 |
| 6,808,415 | B1 * | 10/2004 | Montena | 439/584 |
| 6,884,113 | B1 * | 4/2005 | Montena | 439/578 |
| 7,950,961 | B2 * | 5/2011 | Chabalowski et al. | 439/584 |
| 7,972,176 | B2 * | 7/2011 | Burris et al. | 439/584 |
| 2003/0135999 | A1 * | 7/2003 | Khemakhem et al. | 29/857 |
| 2007/0155233 | A1 * | 7/2007 | Laerke et al. | 439/578 |

* cited by examiner

*Primary Examiner* — Neil Abrams

(57) ABSTRACT

A hardline coaxial cable connector includes a body subassembly, a back nut subassembly and a deformable ferrule disposed within the back nut subassembly. The back nut subassembly is rotatable with respect to the body subassembly and a coaxial cable inserted therein. Axial advancement of the back nut subassembly toward the body subassembly causes the ferrule to deform radially inwardly and be in electrical communication with the body subassembly.

20 Claims, 6 Drawing Sheets

RE-ENTERABLE HARDLINE COAXIAL CABLE CONNECTOR

This application is a continuation-in-part application of application Ser. No. 12/502,633, filed on Jul. 14, 2009, still pending, the contents of which are incorporated by reference in their entirety.

BACKGROUND OF THE INVENTION

1. Field of the Invention

The present invention relates generally to coaxial cable connectors, and particularly to connectors for use with hardline coaxial cables.

1. Technical Background

A hardline coaxial cable typically has a solid center conductor surrounded by a plastic or other dielectric material and encased within an electrically conductive solid outer conductor that may be surrounded by an outer insulative jacket. In application, each end of the cable can be terminated by a connector, which serves to electrically and mechanically engage the cable conductors to communicate signals transmitted therethrough and for gripping the outer conductor to physically secure the cable and prevent detachment during normal operation.

Historically, connectors for hardline coaxial cables have been designed to grip the cable in such a manner as to be removed from the cable at a later time if so desired. Such a feature is generally known as "re-usability." Connectors with this capability are typically constructed of a relatively large number of components (e.g., 12 or 13 components excluding o-rings), are comparatively expensive, and many times fail to release from the cable outer conductor when so desired.

Continued advances in the state of the art have led to a general trend of cost reduced designs along with challenges to certain requirements such as re-usability. Specifically, it has been determined that it may be preferable for a connector to be "re-enterable" as opposed to reusable. In order to be re-enterable, the connector must be capable of being installed on a cable and be further capable of termination with a device or piece of equipment and, at a later time, allow access to the equipment by uncoupling the connector. The connector does not have to be removable from the cable in order to be re-enterable.

SUMMARY OF THE INVENTION

In one aspect, a hardline coaxial cable connector is provided for coupling a coaxial cable having a center conductor, an insulative layer, and an outer conductor to an equipment port, the connector includes a body subassembly having a first end and a second end, the first end adapted to connect to an equipment port and the second end having threads, a detachable back nut subassembly having a first end, a second end, and an inner surface defining an opening extending between the first and second ends, the first end having threads that mate with the threads on the second end of the body subassembly and the second end adapted to receive a prepared end of the coaxial cable, and a deformable ferrule disposed within the opening of the detachable back nut subassembly, wherein the detachable back nut subassembly is rotatable with respect to a coaxial cable inserted therein and the inner surface of the detachable back nut subassembly comprises a tapered portion that decreases from a first diameter between the tapered portion and the first end of the detachable back nut subassembly to a second diameter between the tapered portion and a second end of the detachable back nut subassembly such that as the detachable back nut subassembly is advanced axially toward the body subassembly as a result of the mating of the threads of the body subassembly with the threads of the detachable back nut subassembly and rotating the detachable back nut subassembly relative to the body subassembly, the tapered portion contacts the deformable ferrule and causes at least a portion of the deformable ferrule to deform radially inwardly establishing a gripping and sealing relationship between the deformable ferrule and the outer conductor thereby providing electrical and mechanical communication between the deformable ferrule and the outer conductor, and a front portion of the deformable ferrule contacts the second end of the body subassembly to provide electrical communication between the body subassembly and the outer conductor through the deformable ferrule.

In some embodiments, the deformable ferrule has a groove on an outer surface, the groove has a retaining ring disposed therein to limit the axial movement of the detachable back nut subassembly relative to the deformable ferrule.

In other embodiments, the deformable ferrule has a front face, the front face has at least one slot that engages the second end of the body subassembly, the engagement of the at least one slot against the second end of the body subassembly prevents the deformable ferrule from rotating relative to the body subassembly.

In yet other embodiments, axial advancement of the deformable ferrule toward an actuator causes the actuator to drive cantilevered tines in the body subassembly radially inwardly against the center conductor of a coaxial cable inserted into the socket contact.

In yet another aspect, a method is provided of coupling a hardline coaxial cable having a center conductor, an insulative layer, and an outer conductor to an equipment port, the method includes providing a hardline coaxial cable connector, the connector including a body subassembly having a first end and a second end, the first end adapted to connect to the equipment port and the second end having threads, a detachable back nut subassembly having a first end, a second end, and an inner surface defining an opening extending between the first and second ends, the first end having threads that mate with the threads on the second end of the body subassembly and the second end adapted to receive a prepared end of the hardline coaxial cable, and a deformable ferrule disposed within the opening of the detachable back nut assembly. The method also includes connecting the first end of the body subassembly to the equipment port, inserting the prepared end of a coaxial cable into the second end of the detachable back nut subassembly, and rotating the detachable back nut subassembly relative to the hardline coaxial cable and the body subassembly such that the detachable back nut subassembly is advanced axially toward the body subassembly as a result of the mating of the threads of the body subassembly with the threads of the detachable back nut subassembly, wherein the inner surface of the detachable back nut subassembly comprises a tapered portion that decreases from a first diameter between the tapered portion and the first end of the detachable back nut subassembly to a second diameter between the tapered portion and a second end of the detachable back nut subassembly such that as the detachable back nut subassembly is advanced axially toward the body subassembly, the tapered portion contacts the deformable ferrule and causes at least a portion of the deformable ferrule to deform radially inwardly against the outer conductor of the coaxial cable in order to provide electrical and mechanical communication between the deformable ferrule and the outer conductor, and a front portion of the deformable ferrule contacts the second end of the body subassembly to provide electrical communication between the body subassembly and the outer conductor through the deformable ferrule.

In still yet another aspect, a method is provided of coupling and decoupling a hardline coaxial cable having a center conductor, an insulative layer, and an outer conductor to an equipment port, the method includes coupling the connector as previously described, and then detaching the detachable back nut subassembly from the body subassembly by rotating the detachable back nut subassembly relative to the coaxial cable and the body subassembly such that the detachable back nut subassembly is advanced axially away from the body subassembly as a result of the mating of the threads of the body subassembly with the threads of the detachable back nut subassembly, wherein the electrical and mechanical communication between the deformable ferrule and the outer conductor is maintained upon detachment of the detachable back nut subassembly from the body subassembly.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and together with the description, serve to explain the principles and operations of the invention.

DETAILED DESCRIPTION OF THE PREFERRED EMBODIMENTS

Figure 1:
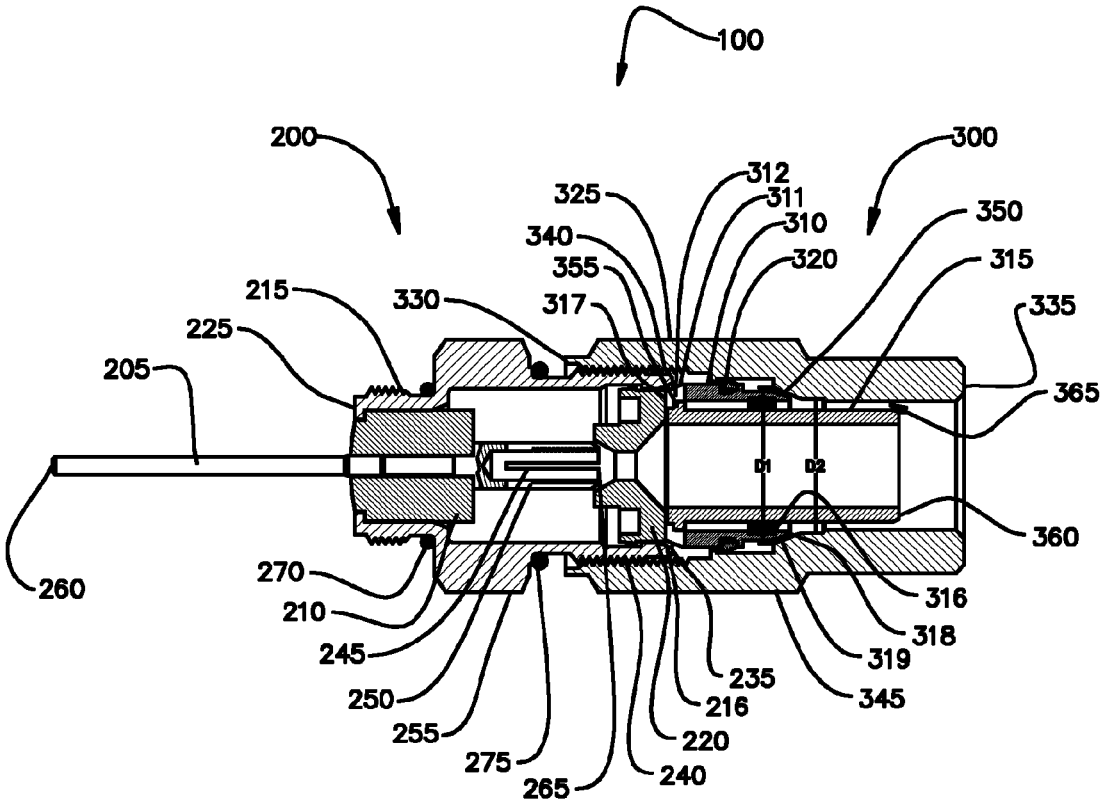
FIG. 1 is a cross section view along the centerline of one embodiment of a connector according to the present invention and is illustrated in the "as shipped" condition ready for installation onto a prepared coaxial cable.

Reference will now be made in detail to the present preferred embodiment(s) of the invention, examples of which are illustrated in the accompanying drawings. Whenever possible, the same reference numerals will be used throughout the drawings to refer to the same or like parts.

Figure 3:
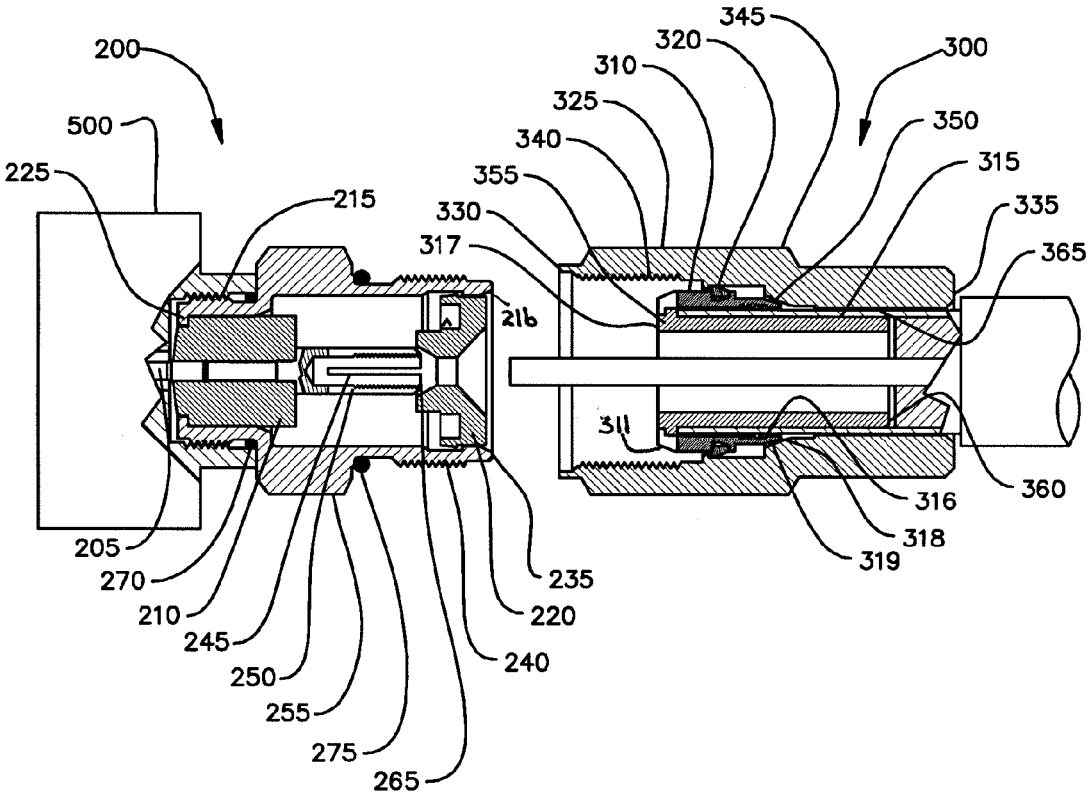
FIG. 3 is a side cross section view along the centerline of the connector in FIG. 1 illustrated in a partially installed condition.

Referring to FIGS. 1 and 3, one embodiment of a connector 100 according to the present invention includes a body subassembly 200 and back nut subassembly 300. Body subassembly 200 includes body 215 made from electrically conductive material, preferably metal such as aluminum, and has a first end 225 adapted to connect to an equipment port 500 (see FIG. 3) and a second end 235 having external threads 240. Body 215 is preferably a generally cylindrical, unitary piece and has a outwardly radially extending area 255 with an outer configuration (such as a hex configuration) that allows the body subassembly 200 to be attached to and tightened on an equipment port using a standard tool, such as a wrench. Body subassembly 200 includes pin 205 made from electrically conductive material, preferably a metal such as tin-plated brass, extending through the first end 225 and accessible from the second end 235. Pin 205 has a front end 260 for connecting to the equipment port 500 and a back end 265, the back end 265 having a socket contact 245 for receiving the center conductor of a coaxial cable. Socket contact 245 preferably includes a plurality of cantilevered tines 250. The second end 235 of the body subassembly 200 has a tapered portion 216. Body subassembly 200 also has an insulator 210 made from electrically non-conductive material, preferably a plastic material such as polycarbonate, disposed adjacent the first end 225 to electrically insulate and center the pin 205. An actuator 220 made from an electrically non-conductive material, preferably plastic such as cycloolefincopolymer also known as Topas® is disposed in the body subassembly 200 adjacent the second end 235. Body subassembly 200 may optionally include o-rings 270 and/or 275 to assist in sealing the junctions of the equipment port/body assembly and the body assembly/back nut assembly.

Figure 6A:
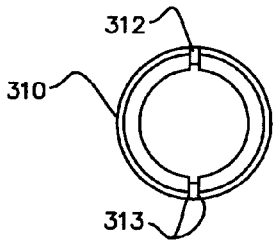
FIG. 6A is a front view of one embodiment of a deformable ferrule according to the present invention for use with the connector in FIG. 1.
Figure 6B:
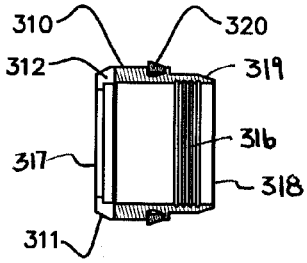
FIG. 6B is a side cross section view along the of the deformable ferrule of FIG. 6A and a retaining ring.
Figure 6C:
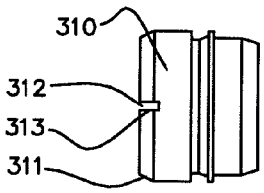
FIG. 6C is a top view of the deformable ferrule of FIG. 6A.

Back nut subassembly 300 includes back nut 325 made from electrically conductive material, preferably a metal such as aluminum, and has a first end 330 having internal threads 340 adapted to mate with external threads 240 and a second end 335 adapted to receive a prepared end of a coaxial cable (see FIG. 3). The inner surface of back nut 325 includes a tapered portion 350 that decreases in diameter from a first diameter D1 between the tapered portion 350 and the first end 330 of the back nut subassembly 300 to a second diameter D2 between the tapered portion 350 and the second end 335 of the back nut subassembly 300. Back nut 325 is preferably a generally cylindrical, unitary piece and preferably has an outwardly radially extending area 345 with an outer configuration (such as a hex configuration) that allows the back nut subassembly 300 to be attached to and tightened on the body subassembly 200 using a standard tool, such as a wrench. Back nut subassembly 300 houses deformable ferrule 310 made from electrically conductive and malleable material, preferably a metal such as aluminum or tin-plated brass. Ferrule 310 has a front end 317 and a back end 318. At the front end 317 of ferrule 310 is a tapered portion 311 and at the ferrule back end 318 is tapered portion 319. See also FIG. 6B. As illustrated in FIGS. 6A-6C, the ferrule 310 has at least one and preferably at least two blind slots 312 at the front end 317. The blind slots 312 have edges 313, which assist in the functioning of the connector 100 as discussed below. Ferrule 310 preferably has an outer diameter that is smaller than first diameter D1 and greater than second diameter D2 of the inner surface of back nut 325. The inner surface of ferrule 310 may optionally have grooves and ridges 316 to enhance gripping of an outer conductor of a coaxial cable. Back nut subassembly 300 also includes a sleeve 315, preferably made from electrically conductive material, which may include a metal such as aluminum. Alternatively, sleeve 315 can be made from a plastic material. Sleeve 315 is a generally cylindrical unitary piece and preferably has an increased diameter front portion 355 and a decreased diameter back portion 360 wherein the outer diameter of back portion 360 is less than second diameter D2 such that an annular gap 365 is present between the outer diameter of back portion 360 and inner surface of back nut 325 at the second diameter D2. The outer diameter of back portion 360 is also smaller than inner diameter of ferrule 310 such that the annular gap 365 also extends between decreased diameter of back portion 360 and the inner surface of ferrule 310. Back nut subassembly 300 includes retaining ring 320 that is disposed around the ferrule 310 as discussed in more detail below.

Figure 2:
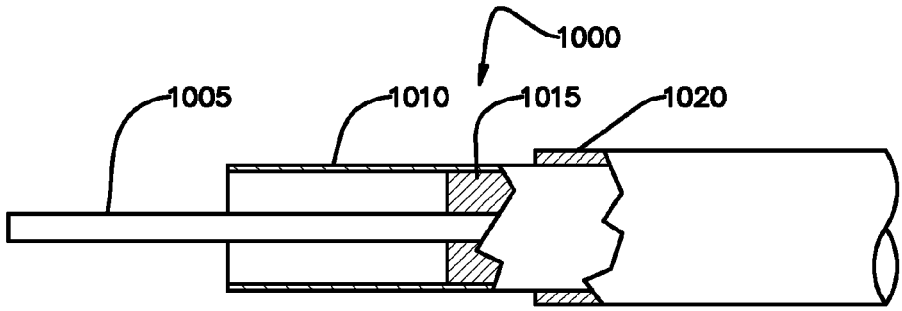
FIG. 2 is a cross section view along the centerline of a prepared end of a hardline coaxial cable for use with the connector in FIG. 1.

Turning to FIG. 2, a prepared end of a hardline coaxial cable 1000 to be used with the connector 100 is shown. Hardline coaxial cable 1000 includes a center conductor 1005 made from electrically conductive material, preferably a metal such as copper clad aluminum, an outer conductor 1010 made from electrically conductive material, preferably a metal such as aluminum, an insulative layer 1015 made from electrically non-conductive material, preferably foamed polyethylene plastic, and, optionally, an outer protective jacket 1020 preferably made from PVC.

FIG. 3 illustrates the connector 100 where the back nut subassembly 300 is detached from the body subassembly 200 and the first end 225 of the body subassembly 200 has been attached to the equipment port 500 and a prepared end of a coaxial cable 1000 has been inserted into the second end 335 of the back nut subassembly 300. As noted above, the connector 100 is shipped in the configuration shown in FIG. 1, and an installer detaches the back nut subassembly 300 from the body subassembly 200. Next, the installer attaches the first end 225 of the body subassembly 200 to an equipment port 500 and inserts the prepared end of the hardline coaxial cable 1000 into the second end 335 of the back nut subassembly 300. Preferably, back nut subassembly 300 houses sleeve 315 such that the outer conductor 1010 of hardline coaxial cable 1000 is inserted into annular gap 365 between the back portion 360 of the sleeve 315 and the inner surface at second diameter D2 and between the back portion 360 of the sleeve 315 and the inner surface of the ferrule 310. At this point, the back nut subassembly 300, with the prepared end of the hardline coaxial cable 1000 inserted therein, is ready to be reattached to the body subassembly 200.

Figure 4:
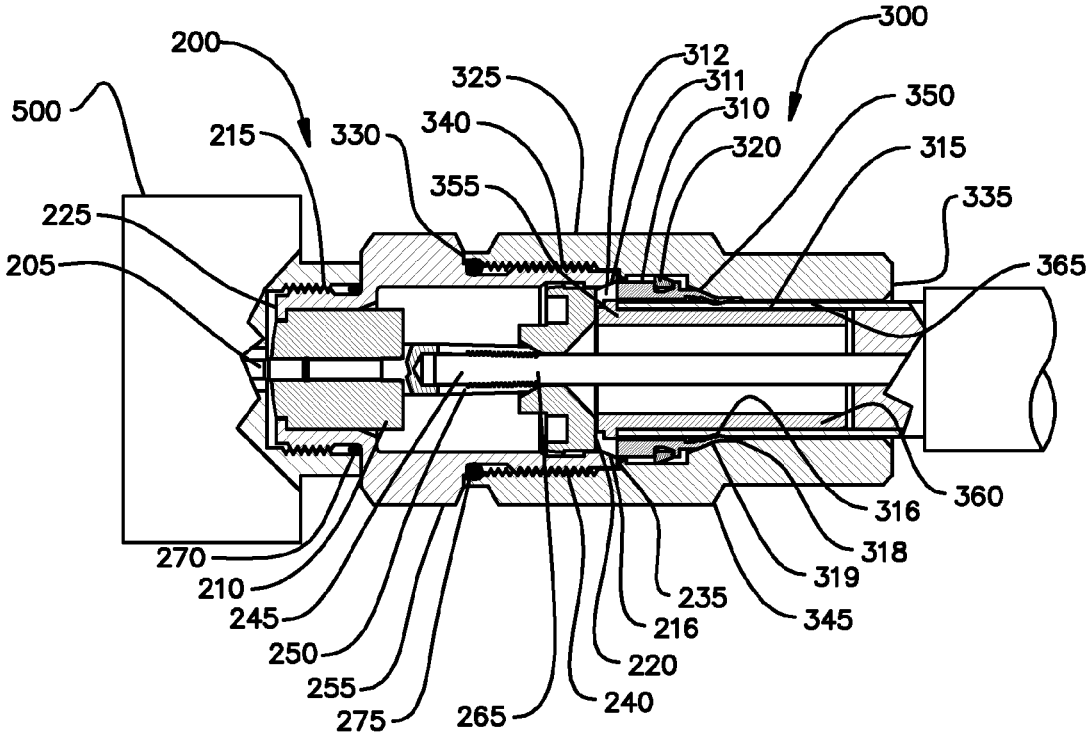
FIG. 4 is a side cross section view along the centerline of the connector in FIG. 1 illustrated in a fully installed condition.

FIG. 4 illustrates the connector 100 where back nut subassembly 300 has been fully installed and tightened on body subassembly 200. The back nut subassembly 300, including back nut 325, is rotatable with respect to both the body subassembly 200 already attached to the equipment port 500 and the hardline coaxial cable 1000 inserted therein. As the back nut subassembly 300 is advanced axially toward the body subassembly 200 as a result of the mating of the external threads 240 of the body subassembly 200 with the internal thread 340 of the back nut subassembly 300 and rotating the back nut subassembly 300 relative to the body subassembly 200 and the hardline coaxial cable 1000, the tapered portion 311 at the front end 317 of the ferrule 310 engages the tapered portion 216 at the second end 235 of the body 215. Edges 313 of the blind slots 312 on the ferrule 310 engage tapered surface 216 of the body 215 normal to, or at least nearly normal to, the tapered surface 216 of the body 215, causing the ferrule 310 to resist rotation relative to the body 215.

As the back nut subassembly 300 is continually advanced axially toward the body subassembly 200 as a result of the mating of the external threads 240 of the body subassembly 200 with the internal thread 340 of the back nut subassembly 300 and rotating the back nut subassembly 300 relative to the body subassembly 200 and the hardline coaxial cable 1000, the tapered portion 350 contacts the ferrule 310 at the tapered portion 319 at the back end 318 and causes at least a portion of the ferrule 310 to deform radially inwardly as shown in FIG. 4. As the ferrule 310 deforms radially inwardly against outer conductor 1010 of the hardline coaxial cable 1000, a gripping and sealing relationship is established between the ferrule 310 and the outer conductor 1010 of the hardline coaxial cable 1000 providing electrical and mechanical communication between ferrule 310 and outer conductor 1010. Back nut subassembly 300 preferably houses sleeve 315 such that as the ferrule 310 deforms radially inwardly against the outer conductor 1010, at least a portion of the outer conductor 1010 that is inserted between the decreased diameter of back portion 360 of the sleeve 315 and the inner surface of ferrule 310 is clamped between the sleeve 315 and the ferrule 310 as shown in FIG. 4. Meanwhile, the center conductor 1005 is received in socket contact 245 and axial advancement of the ferrule 310 (and possibly sleeve 315) toward actuator 220 causes actuator 220 to drive cantilevered tines 250 radially inward against center conductor 1005 with the chamfered portion of the actuator 220. In the installed position in FIG. 4, electrical communication between the outer conductor 1010 and the body 215 of the body subassembly 200 is established through the ferrule 310.

Figure 5:
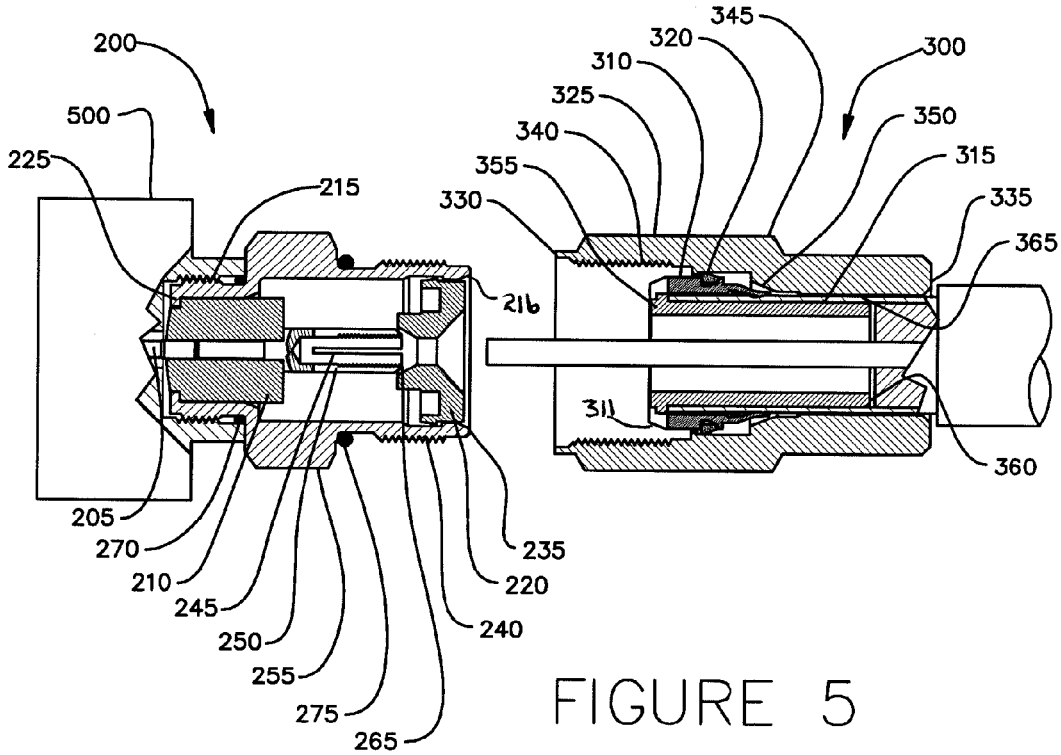
FIG. 5 is a side cross section view along the centerline of the connector in FIG. 1 illustrated as fully installed and then detached condition.

FIG. 5 shows the connector 100 in the re-enterable state wherein back nut subassembly 300 has been detached from body subassembly 200, and body subassembly 200 remains installed in equipment port 500. Back nut subassembly 300 is detached from body subassembly 200 by rotating the back nut 325 relative to the hardline coaxial cable 1000 and the body subassembly 200 such that the back nut subassembly 300 is advanced axially away from the body subassembly 200 as a result of the mating of the external threads 240 of the body subassembly 200 with the internal threads 340 of the back nut subassembly 300. During and after detachment of back nut subassembly 300 from body subassembly 200, the inward radial deformation of ferrule 310 against the outer conductor 1010 that occurred during the first installation is maintained as shown in FIG. 5. Likewise, electrical and mechanical communication between ferrule 310 and outer conductor 1010 is maintained upon detachment of back nut subassembly 300 from body subassembly 200. In addition, back nut subassembly 300 houses sleeve 315 such that the clamping of at least a portion of outer conductor 1010 between sleeve 315 and ferrule 310 (or at least a portion of the clamped region between sleeve 315 and ferrule 310) is maintained upon detachment of the back nut subassembly 300 from the body subassembly 200. Upon detachment, back nut 325 remains rotatably captivated about cable 1000 and will re-seat against ferrule 310 upon re-installation to body assembly 200.

Ferrule 310 is preferably permanently deformed around the outer conductor 1010, and back nut subassembly 300 can be repeatedly attached to and detached from body subassembly 200 while still maintaining electrical and mechanical communication and environmental sealing between ferrule 310 and outer conductor 1010. In addition, back nut subassembly 300 can be repeatedly attached to and detached from body subassembly 200 while still maintaining the clamp of at least a portion of outer conductor 1010 between sleeve 315 and ferrule 310. As a result, electrical and mechanical communication is maintained between outer conductor 1010 and both ferrule 310 and sleeve 315, allowing ferrule 310 to function as a coaxial outer conductor. An outer conductor path can then be continued from the ferrule 310 to the body 215 (see, e.g., FIG. 4 showing electrical and mechanical communication between ferrule front end 317 and body 215) and therethrough to the equipment port 500.

Figure 7A:
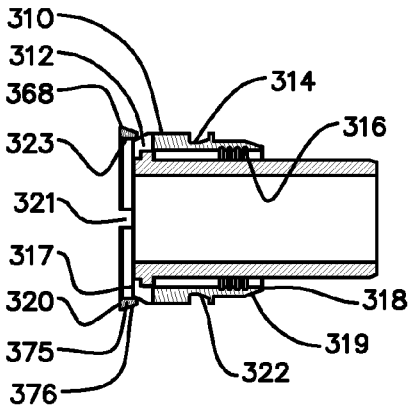
FIGS. 7A-7F illustrate partial cross section views of portions of the connector illustrated in FIG. 1 showing various stages of component assembly.

Turning to FIG. 7A, the retaining ring 320 is illustrated in a state of partial assembly on the ferrule 310. Retaining ring 320 is axially advanced over the tapered portion 311 at the front end 317 of the ferrule 310 in the direction of the second end 318 of the ferrule 310. The retaining ring 320 has a generally c-shaped configuration and a slot 321 in the retaining ring 320 permits the retaining ring 320 to expand and pass over the ferrule 310 as illustrated in FIG. 7B. It is noted that the sleeve 315 is also illustrated as being disposed within the ferrule 310.

Figure 7D:
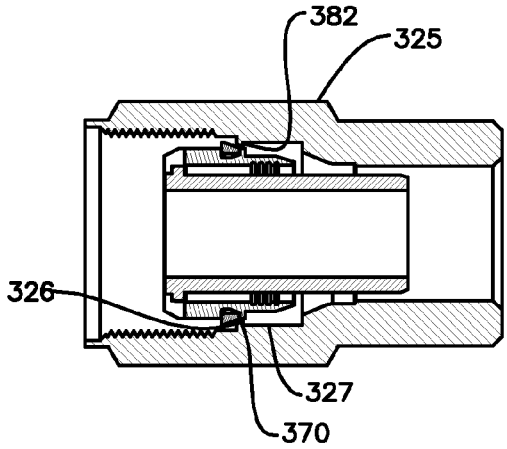
Figure 7B:
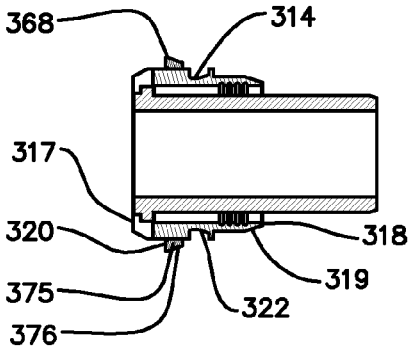
Figure 7E:
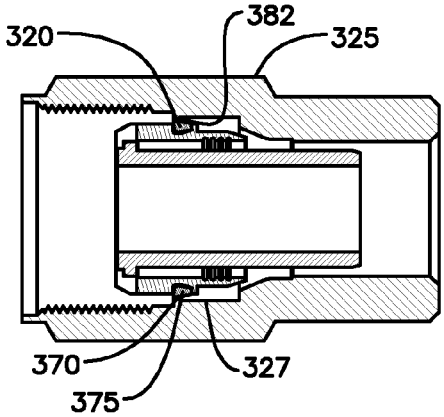
Figure 7C:
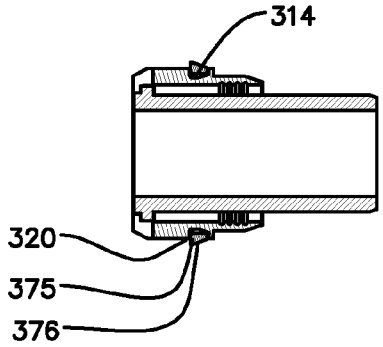

In FIG. 7C, retaining ring 320 is axially advanced into a groove 314 extending radially inwardly in the outer surface of the ferrule 310. Retaining ring 320, due to its resilient nature, snaps into the groove 314 and is forced to remain relatively radially evenly disposed about the groove 314 by contact between the tapered portion 322 of the groove 314 in the ferrule 310 and the internal surface 323 of the retaining ring 320. This centering action causes retaining ring 320 to be co-cylindrically aligned with the ferrule 310.

In FIG. 7D, the back nut 325 is axially advanced from the second end 318 of the ferrule 310 in the direction of the front end 317 of the ferrule 310. As a result of the axial advancement of the back nut 325, the retaining ring 320, which is disposed about the ferrule 310, is also disposed at least partially within the through bore 370 of the back nut 325. Coincidentally, as the back nut 325 is axially advanced towards the front end 317 of the ferrule 310, the chamfer 326 of the back nut 325 begins to funnel the retaining ring 320 into the recess 327 of the back nut 325.

In FIG. 7E, upon further advancement of the back nut 325 over the ferrule 310 and over the retaining ring 320, contact between the through bore 370 and tapered diameter 368 of the retaining ring 320 causes the retaining ring 320 to compress radially inwardly. Specifically, the through bore 370 forces the cross sectional beam 375 of the retaining ring 320 to radially compress in diameter and also torsionally conform to both the groove 314 and the tapered portion 322 of the ferrule 310, allowing the back nut 325 to continue to advance without the need for alignment and/or pre-compression tooling to be applied to the retaining ring 320 in what is known as a blind assembly operation.

Figure 7F:
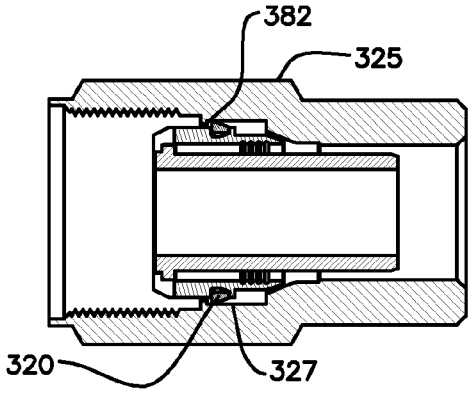

In FIG. 7F, the back nut 325 is completely advanced until the retaining ring 320 passes completely beyond the through bore 370 and into recess 327 of the back nut 325, at which point the retaining ring 320 is permitted to re-expand radially outwardly to its original configuration, now diametrally bounded within the recess 327 and axially bounded by the rearward facing annular shoulder 382. Back nut 325 now rotatably engages the ferrule 310 while permitting only limited axial movement of the ferrule 310 within the recess 327. Simultaneously, ferrule 310 remains co-cylindrically aligned with the back nut 325 as a result of the retaining ring 320.

Figure 8:
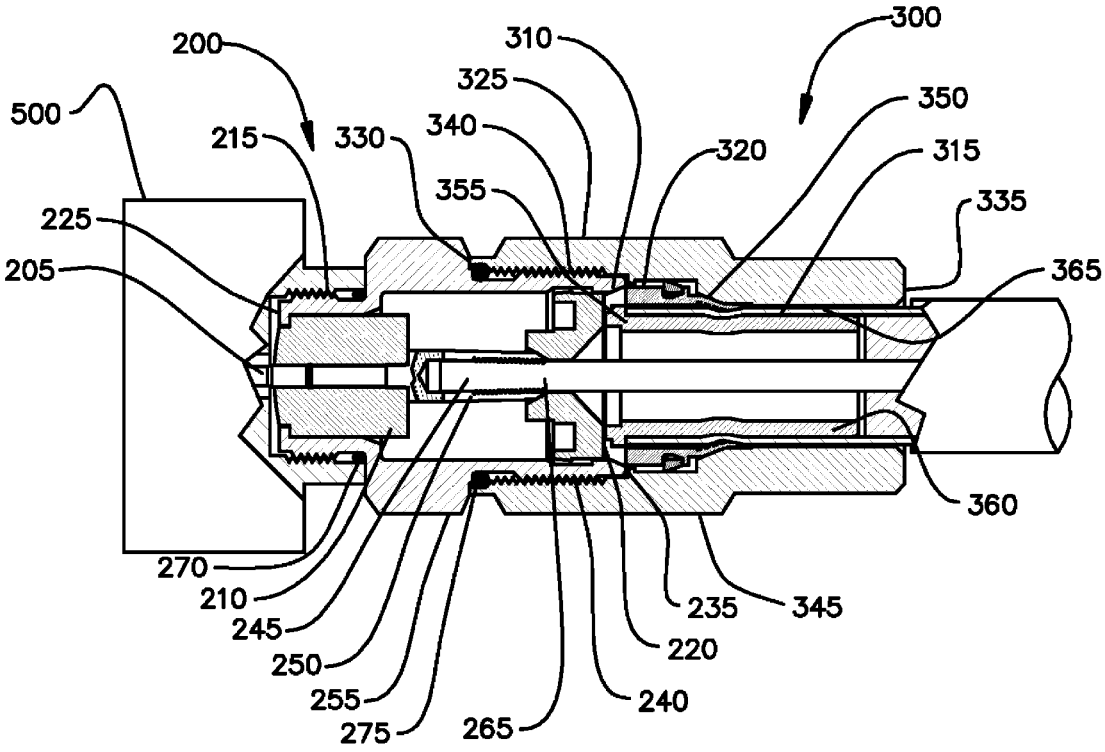
FIG. 8 is a side cross section view along the centerline of another embodiment of a connector according to the present invention.

FIG. 8 is a cross section view along the centerline of an optional embodiment where greater pressure is exerted on the clamping mechanism, purposely forming in the outer conductor 1010 and the sleeve 315 a localized annular depression. In this configuration, the ferrule 310 is circumferentially compressed by the tapered portion 350 with enough pressure to cause localized annular depressions of both the outer conductor 1010 and the sleeve 315. As a result, resistance to Radio Frequency Interference leakage ca Can be increased by the relatively convoluted path created by the radial deformation and outer conductor retention characteristics can be improved. The variance in impedance match caused by the localized annular depression can be electrically compensated by incorporating internal step features or bores (not shown) in sleeve front end 355, and can thereby render excellent electrical performance characteristics such as improved Return Loss and reduced Radio Frequency Interference (radiation of signal).

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

We claim:

1. A hardline coaxial cable connector for coupling a coaxial cable having a center conductor, an insulative layer, and an outer conductor to an equipment port, the connector comprising:

a body subassembly having a first end and a second end, the first end adapted to connect to an equipment port and the second end having threads;

a detachable back nut subassembly having a first end, a second end, and an inner surface defining an opening extending between the first and second ends, the first end having threads that mate with the threads on the second end of the body subassembly and the second end adapted to receive a prepared end of the coaxial cable; and a deformable ferrule disposed within the opening of the detachable back nut subassembly;

wherein the detachable back nut subassembly is rotatable with respect to a coaxial cable inserted therein and the inner surface of the detachable back nut subassembly comprises a tapered portion that decreases from a first diameter between the tapered portion and the first end of the detachable back nut subassembly to a second diameter between the tapered portion and a second end of the detachable back nut subassembly such that as the detachable back nut subassembly is advanced axially toward the body subassembly as a result of the mating of the threads of the body subassembly with the threads of the detachable back nut subassembly and rotating the detachable back nut subassembly relative to the body subassembly, the tapered portion contacts the deformable ferrule and causes at least a portion of the deformable ferrule to deform radially inwardly establishing a gripping and sealing relationship between the deformable ferrule and the outer conductor thereby providing electrical and mechanical communication between the deformable ferrule and the outer conductor, and a front portion of the deformable ferrule contacts the second end of the body subassembly to provide electrical communication between the body subassembly and the outer conductor through the deformable ferrule.

2. The hardline coaxial cable connector of claim 1, wherein the deformable ferrule has a groove on an outer surface, the groove having a retaining ring disposed therein to limit the axial movement of the detachable back nut subassembly relative to the deformable ferrule.

3. The hardline coaxial cable connector of claim 1, wherein the electrical and mechanical communication between the deformable ferrule and the outer conductor is maintained upon detachment of the detachable back nut subassembly from the body subassembly.

4. The hardline coaxial cable connector of claim 1, wherein the connector further comprises a sleeve disposed within the back nut subassembly, the deformable ferrule being disposed around at least a portion of the sleeve.

5. The hardline coaxial cable connector of claim 4, wherein the deformable ferrule is adapted to deform radially inwardly against the outer conductor of a coaxial cable inserted into the second end of the detachable back nut subassembly, wherein at least a portion of the outer conductor is inserted between an outer diameter of the sleeve and an inner diameter of the deformable ferrule, such that as the deformable ferrule deforms radially inwardly against the outer conductor, at least a portion of the outer conductor is clamped between the sleeve and the deformable ferrule.

6. The hardline coaxial cable connector of claim 5, wherein at least a portion of the clamped region between the sleeve and the deformable ferrule is maintained upon detachment of the detachable back nut subassembly from the body subassembly.

7. The hardline coaxial connector of claim 5, wherein the deformable ferrule is adapted to cause a localized annular depression of the outer conductor and sleeve where at least a portion of the outer conductor is clamped between the sleeve and the deformable ferrule.

8. The hardline coaxial cable connector of claim 1, wherein the deformable ferrule has a front face, the front face having at least one slot that engages the second end of the body subassembly, the engagement of the at least one slot against the second end of the body subassembly preventing the deformable ferrule from rotating relative to the body subassembly.

9. The hardline coaxial cable connector of claim 1, wherein the body subassembly houses a conductive pin, the conductive pin having a front end for connecting to the equipment port and a back end, the back end comprising a socket contact for receiving the center conductor of a coaxial cable, the socket contact comprising a plurality of cantilevered tines.

10. The hardline coaxial cable connector of claim 9, wherein the connector further comprises an actuator disposed within the body subassembly.

11. The hardline coaxial cable connector of claim 10, wherein axial advancement of the deformable ferrule toward the actuator causes the actuator to drive the cantilevered tines radially inwardly against the center conductor of a coaxial cable inserted into the socket contact.

12. A method of coupling a hardline coaxial cable having a center conductor, an insulative layer, and an outer conductor to an equipment port, the method comprising:

providing a hardline coaxial cable connector comprising:

a body subassembly having a first end and a second end, the first end adapted to connect to the equipment port and the second end having threads;

a detachable back nut subassembly having a first end, a second end, and an inner surface defining an opening extending between the first and second ends, the first end having threads that mate with the threads on the second end of the body subassembly and the second end adapted to receive a prepared end of the hardline coaxial cable; and a deformable ferrule disposed within the opening of the detachable back nut assembly;

connecting the first end of the body subassembly to the equipment port;

inserting the prepared end of a coaxial cable into the second end of the detachable back nut subassembly; and rotating the detachable back nut subassembly relative to the hardline coaxial cable and the body subassembly such that the detachable back nut subassembly is advanced axially toward the body subassembly as a result of the mating of the threads of the body subassembly with the threads of the detachable back nut subassembly;

wherein the inner surface of the detachable back nut subassembly comprises a tapered portion that decreases from a first diameter between the tapered portion and the first end of the detachable back nut subassembly to a second diameter between the tapered portion and a second end of the detachable back nut subassembly such that as the detachable back nut subassembly is advanced axially toward the body subassembly, the tapered portion contacts the deformable ferrule and causes at least a portion of the deformable ferrule to deform radially inwardly against the outer conductor of the coaxial cable in order to provide electrical and mechanical communication between the deformable ferrule and the outer conductor, and a front portion of the deformable ferrule contacts the second end of the body subassembly to provide electrical communication between the body subassembly and the outer conductor through the deformable ferrule.

13. The method of claim 12, wherein the method further comprises detaching the detachable back nut subassembly from the body subassembly prior to connecting the first end of the body subassembly to the equipment port and then reattaching the detachable back nut subassembly to the body subassembly subsequent to inserting the prepared end of the coaxial cable into the second end of the detachable back nut subassembly.

14. The method of claim 12, wherein the connector further comprises a sleeve disposed within the back nut subassembly, the deformable ferrule being disposed around at least a portion of the sleeve.

15. The method of claim 14, wherein at least a portion of the outer conductor is inserted between an outer diameter of the sleeve and an inner diameter of the deformable ferrule, such that as the deformable ferrule deforms radially inwardly against the outer conductor, at least a portion of the outer conductor is clamped between the sleeve and the deformable ferrule.

16. The method of claim 15, wherein the deformable ferrule causes a localized annular depression of the outer conductor and sleeve where at least a portion of the outer conductor is clamped between the sleeve and the deformable ferrule.

17. The method of claim 12, wherein the body subassembly houses a conductive pin, the conductive pin having a front end for connecting to the equipment port and a back end, the back end comprising a socket contact for receiving the center conductor of a coaxial cable, the socket contact comprising a plurality of cantilevered tines.

18. The method of claim 17, wherein the hardline coaxial cable connector further comprises an actuator disposed within the body subassembly and wherein axial advancement of the deformable ferrule toward the actuator causes the actuator to drive the cantilevered tines radially inwardly against the center conductor of a coaxial cable inserted into the socket contact.

19. A method of coupling and decoupling a hardline coaxial cable having a center conductor, an insulative layer, and an outer conductor to an equipment port, the method comprising:

performing the method of claim 12 to couple the coaxial cable to the equipment port; and detaching the detachable back nut subassembly from the body subassembly by rotating the detachable back nut subassembly relative to the coaxial cable and the body subassembly such that the detachable back nut subassembly is advanced axially away from the body subassembly as a result of the mating of the threads of the body subassembly with the threads of the detachable back nut subassembly;

wherein the electrical and mechanical communication between the deformable ferrule and the outer conductor is maintained upon detachment of the detachable back nut subassembly from the body subassembly.

20. The method of claim 19, wherein the connector further comprises a sleeve disposed within the back nut subassembly and at least a portion of the outer conductor is inserted between an outer diameter of the sleeve and an inner diameter of the deformable ferrule, such that as the deformable ferrule deforms radially inwardly against the outer conductor, at least a portion of the outer conductor is clamped between the sleeve and the deformable ferrule and wherein the clamp of at least a portion of the outer conductor between the sleeve and the deformable ferrule is maintained upon detachment of the detachable back nut subassembly from the body subassembly.

* * * * *